US006328659B1

(12) United States Patent
Peterson

(10) Patent No.: US 6,328,659 B1
(45) Date of Patent: Dec. 11, 2001

(54) GOLF BALL DISPENSING AND TEEING DEVICE

(76) Inventor: Arthur H. Peterson, 6716 Gretchen Pl. North, Oakdale, MN (US) 55128

( * ) Notice: Subject to any disclaimer, the term of this patent is extended or adjusted under 35 U.S.C. 154(b) by 0 days.

(21) Appl. No.: 09/288,183

(22) Filed: Apr. 8, 1999

(51) Int. Cl.[7] ..... A63B 57/00
(52) U.S. Cl. ..... 473/137
(58) Field of Search ..... 473/132–137

(56) References Cited

U.S. PATENT DOCUMENTS

| | | | |
|---|---|---|---|
| 2,071,356 | 2/1937 | Pagett | 473/137 |
| 2,171,299 | 8/1939 | Beckett | 473/137 |
| 2,216,853 | 10/1940 | Middleton | 473/137 |
| 2,285,342 | 6/1942 | MacLellan | 473/137 |
| 2,675,237 | 4/1954 | Willcox | 473/137 |
| 3,127,177 | 3/1964 | Benkoe | 473/137 |
| 3,599,983 | 8/1971 | Melton | 473/137 |
| 4,146,232 | 3/1979 | Stone . | |
| 4,360,204 | 11/1982 | Karr | 473/137 |
| 4,796,893 | 1/1989 | Choi | 473/137 |
| 4,995,614 | 2/1991 | Tange | 473/137 |
| 5,346,222 * | 9/1994 | Luther, Sr. | 473/137 |
| 5,411,267 | 5/1995 | Burks et al. | 473/137 |
| 5,458,339 | 10/1995 | Wildes | 473/137 |
| 5,464,223 | 11/1995 | Dermott | 473/137 |
| 5,549,518 | 8/1996 | Wang | 473/137 |
| 5,624,325 * | 4/1997 | Smith | 473/137 |
| 5,665,004 | 9/1997 | Vlahovic | 473/137 |
| 5,674,130 | 10/1997 | Egan | 473/137 |
| 5,704,844 | 1/1998 | Luther | 473/137 |

* cited by examiner

*Primary Examiner*—Steven Wong
(74) *Attorney, Agent, or Firm*—Frederickson & Byron, P.A.

(57) ABSTRACT

A golf ball dispensing and teeing device that is capable of automatically depositing a golf ball on a fixed tee or other desired location. The golf ball dispensing and teeing device has only one moving part and deposits the golf ball in an easy fashion without regard to whether the golfer is predominately left-handed or right-handed. The golf ball dispensing and teeing device includes a housing that is capable of storing a multiple of golf balls in a generally serpentine fashion as well as a guide assembly that transports a golf ball from the housing to the desired location.

8 Claims, 4 Drawing Sheets

GOLF BALL DISPENSING AND TEEING DEVICE

FIELD OF THE INVENTION

The present invention relates generally to a device for automatically dispensing golf balls. More specifically, the present invention concerns a device that houses multiple golf balls and is capable of dispensing the golf balls one at a time and positioning each golf ball at a predetermined location such as a golf tee, thereby allowing a golfer to repeatedly hit golf balls deposited at the desired location without significantly altering the golfing stance.

BACKGROUND OF THE INVENTION

The sport of golf requires extensive practice in order to improve one's game. Thus, most golfers will practice hitting golf balls off of the ground or a tee to enhance such characteristics as distance the ball travels and accuracy in placing the ball. Repeatedly hitting golf balls is also a beneficial exercise for improving one's golfing stance, particularly for beginners initially learning how to play golf.

Although a golfer can practice hitting golf balls in a variety of settings that have the necessary space available, driving ranges are a popular means for allowing golfers to repeatedly practice hitting golf balls in a controlled and safe environment. Most driving ranges will have several stations set up for golfers. The stations typically contain an artificial tee made out of rubber or other resilient material that allow for golf balls to be repeatedly hit off of it without destroying the tee. The tee is usually positioned on artificial turf or simulated grass which allows for the ball to be hit directly off of such surface as well.

When practicing hitting a golf ball, the golfer will take a golf ball from the container of golf balls provided by the driving range, position the golf ball on the tee or turf surface, position themselves into the proper golfing stance and then hit the golf ball. This entire procedure is then repeated until the container of golf balls is empty or the golfer no longer wishes to practice hitting golf balls.

The above procedure, however, has several disadvantages. First, it requires the golfer to manually acquire a golf ball from the container and position it upon the tee. This requires the golfer to repeatedly crouch or bend down both to retrieve a golf ball and to place the golf ball on the tee. Such movement is inconvenient, places unnecessary stresses upon the golfer's body, and for some golfers with disabilities or ailments, impossible or painful.

Second, requiring a golfer to change their position after hitting a ball can be detrimental to the golfer's training. A proper stance is critical to properly hitting a golf ball and many golfers, particularly beginners, focus extensively on obtaining and practicing a proper stance. Many such golfers use a driving range as a means of practicing a correct stance. Thus, after placing a golf ball on the tee, the golfer will attempt to position themselves in a correct stance and then hit the golf ball. However, if the golfer is required to manually place the golf ball on the tee after hitting a ball, a golfer who achieved the correct stance will then be forced to move out of that stance in order to position the next golf ball on the tee. The golfer must then attempt to obtain a correct stance all over again rather than practice hitting several golf balls in a row from a correct stance.

In an effort to overcome these disadvantages, mechanized golf ball dispensers have been developed. However, the configuration of many of these golf ball dispensers makes them expensive or problematic. For example, in order to be effective, the golf ball dispenser should be able to store and dispense a large number of golf balls. The configuration of the golf ball dispenser, however, must ensure that the stored golf balls do not congregate in a manner that prevents them from descending to the dispensing mechanism.

U.S. Pat. No. 5,665,004 issued to Vlahovic depicts a golf ball dispenser in which the golf balls are stored in a bowl positioned above the dispensing assembly. The golf balls travel from the bowl to the dispensing assembly via a vertical tube. Storing golf balls in such an arrangement, however, could easily result in the golf balls bunching together and blocking the tube opening leading to the dispensing assembly, thereby preventing any golf balls from reaching the dispensing assembly.

Another disadvantage of some prior art golf ball dispensers is that they employ their own fixed tee. An example of this design is U.S. Pat. No. 5,674,130 issued to Eagan. This patent relates to a device that dispenses a golf ball so that it rests upon the dispenser's own fixed tee. However, the stations at most driving ranges include a tee. Thus, a golf ball dispenser with its own fixed tee interferes with the use of a dispenser at a driving range. Additionally, golfers may also desire to practice hitting golf balls off of the ground and thus, not want to position the golf ball on a tee. A golf ball dispenser with a fixed tee is not appropriate for such swings.

Another disadvantage of many prior art golf ball dispensers is their complexity. In addition to adding to the cost of the dispensers, complex dispensers or dispensers with many moving parts increases the risk of failure and misuse as well as lead to higher maintenance costs for the dispenser.

Some prior art golf ball dispensers have a further disadvantage in that they are difficult to operate for either a right or left handed golfer. For example, U.S. Pat. No. 4,995,614 issued to Tange discloses a golf ball dispenser in which the golfer begins the process of placing a golf ball on a tee by activating a trigger pad. The golf ball delivery chute is positioned at one end of the golf ball dispenser while the trigger pad is positioned at the opposite end of the golf ball dispenser. Thus, in order to activate the trigger pad a right handed golfer must extend across his or her body to reach the trigger pad. This could be awkward for the golfer and potentially cause the golfer to unintentionally strike the delivery chute or other portion of the golf ball dispenser.

Finally, another disadvantage of many prior art golf ball dispensers is the jazz limited number of environments in which they can be used. Many prior art golf ball dispensers either deposit the golf ball onto a fixed tee that is integrated into the golf ball dispenser itself or deposit the golf ball through a hole directly onto the ground. However, golfers would have a desire to use an automatic golf ball dispenser not only in a driving range where a fixed tee is available but also in less controlled, but more realistic environments, such as in a golfer's back yard where no fixed tee is provided. As mentioned previously, however, if a golf ball dispenser includes a fixed tee, it can be difficult to use such a dispenser in a driving range which typically already includes a fixed tee.

On the other hand, a golf ball dispenser that does not incorporate a fixed tee would have limited applicability in an environment outside of a driving range. Without a fixed tee, a golfer would be required to properly position a new tee every time the golfer wishes to hit a golf ball. Such a requirement negates much of the advantages achieved from a mechanized golf ball dispenser.

Thus, a need exists for an automated golf ball dispenser that has the capacity to hold a multiple of golf balls in an arrangement that does not lead to the golf balls jamming the pathway to the dispenser assembly. A need also exists for a golf ball dispenser that is adaptable for use with or without a fixed tee. A need also exists for a golf ball dispenser that is relatively simple in configuration as well as operation. A need also exists for a golf ball dispenser that has little maintenance requirements. Finally, a need exists for a golf ball dispenser that is equally accessible to both right and left hand golfers.

The present invention accomplishes all the above goals through the use of a golf ball dispenser and teeing apparatus with several unique characteristics. These characteristics include a configuration that prevents jamming of the golf balls, a simplified dispensing activation and placement assembly and a configuration adaptable for use in a variety of environments.

SUMMARY OF THE INVENTION

The present invention concerns an automatic golf ball dispensing and teeing apparatus that upon activation by a golfer, is capable of dispensing a golf ball and positioning the golf ball upon a predetermined location, such as a fixed tee. The golf ball dispensing and teeing apparatus uses a series of interwoven sloped ramps to store the golf balls and direct them to the dispensing arm. The dispensing arm is centered in relation to the stored golf balls and can be activated by either a right handed or left handed golfer in an equally convenient manner.

After travelling down the sloped ramps, a golf ball is positioned at one end of the dispensing arm. In order to position a golf ball onto a tee, the golfer, through the use of the golf club or other device, pivots the dispensing arm downward. This action causes a golf ball to roll down the delivery arm and drop through a hole at the other end of the delivery arm, thereby depositing the golf ball upon a tee or positioning the golf ball upon the ground at the location desired by the golfer.

DETAILED DESCRIPTION OF THE INVENTION

As can be seen from FIGS. 1–5, the present invention concerns a golf ball dispensing and teeing device 10. The golf ball dispensing and teeing device 10 is suitable for positioning a golf ball 12 at a predetermined location, such as a fixed tee provided at a station at a driving range. The golf ball dispensing and teeing device 10 is also suitable for positioning a golf ball 12 upon a fixed tee 14 incorporated into the golf ball dispensing and teeing device 10, thereby allowing the golf ball dispensing and teeing device 10 to be used in settings other than a driving range.

Figure 1:
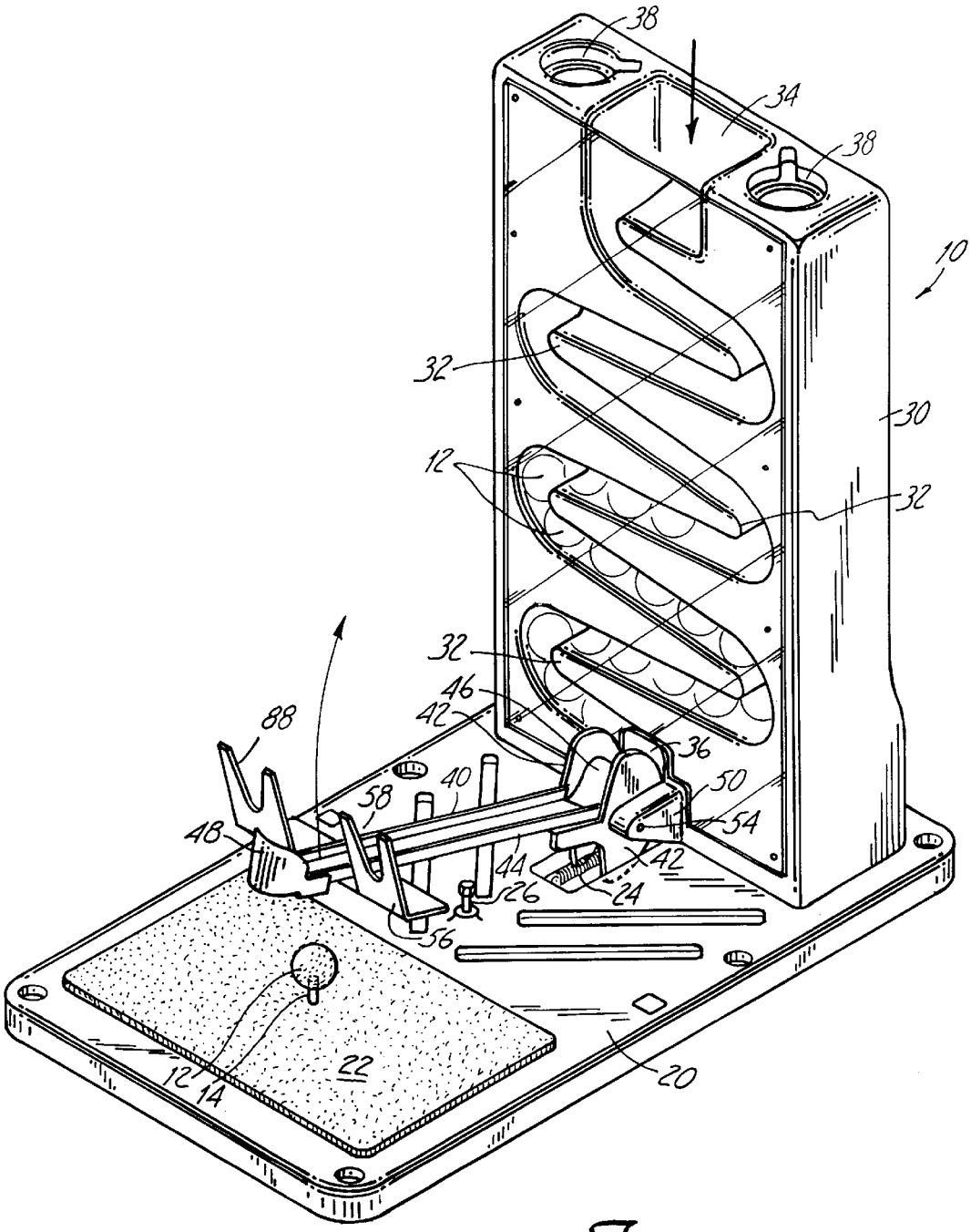
FIG. 1 is a perspective view of the invention.
Figure 2:
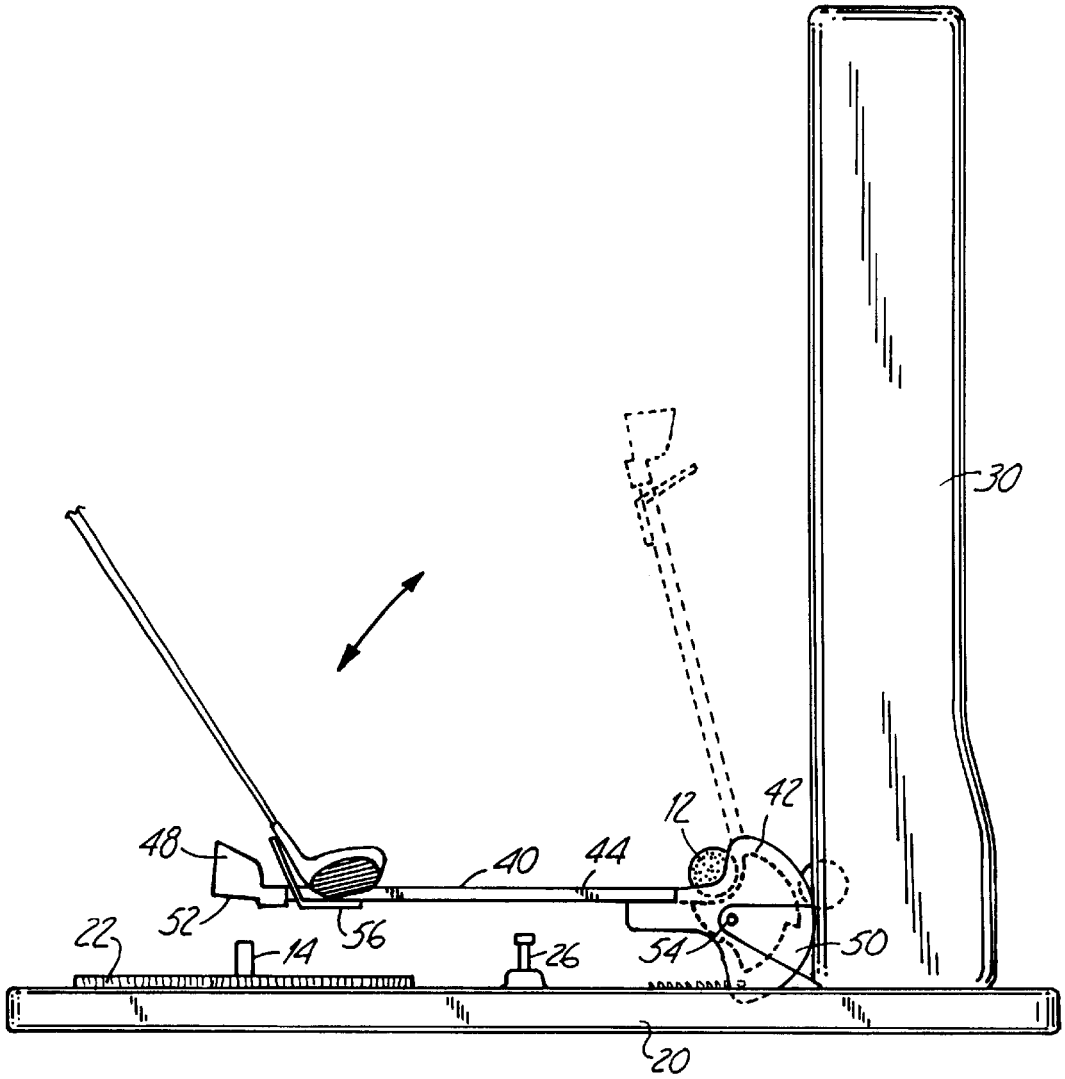
FIG. 2 is a side view of the invention showing the guide assembly in its first and second position.

As shown in FIG. 1, the golf ball dispensing and teeing device 10 includes a base 20, a housing 30 and a guide assembly 40. The golf ball dispensing and teeing device 10 and its specific components can be constructed of any appropriate materials. Considerations of the materials used include the necessary strength and durability required of the device balanced with the desire for relatively lightweight device so that the golf ball dispensing and teeing device 10 is portable. The choice of materials for the components will also need to insure that the device properly operates as intended.

Suitable materials from which the golf ball dispensing and teeing device 10 can be constructed include wood, wherein the various components are attached together through the use of screws, nails or other appropriate attachment devices. The golf ball dispensing and teeing device could also be molded from suitable plastics such as polyethylene.

It will be appreciated that the dimensions of the golf ball dispensing and teeing device 10 can vary depending on the capacity of golf balls desired to be housed as well as the characteristics of the environment in which the device is to be used. In this regard, if the device 10 is to be permanently or semi permanently affixed to the ground, such as possibly at a driving range, the weight of the device may not be as much of a factor as the golf ball storage capacity and durability of the device 10. On the other hand, if the device 10 is meant to be transported about manually then the weight and streamlined capabilities of the device 10 tend to be more of a consideration.

As mentioned, the golf ball dispensing and teeing device 10 includes a base 20. The base 20 can be of any suitable configuration. As can be in FIG. 1, in one preferred embodiment the base 20 is generally rectangular in shape. In an alternate embodiment the base 20 is generally square in shape.

The configuration of the base 20 can exist in several different embodiments. In one such embodiment, the base 20 extends beneath and beyond the end of the guide assembly 40. In one further embodiment of this configuration, artificial grass, turf or other substance 22 is located at one end of the base 20. The turf 22 is positioned so that it is underneath the end of the guide assembly 40 when the guide assembly 40 is in its second or generally horizontal position.

As shown in FIG. 1, in an alternate embodiment, the turf 22 extends outwardly beyond the end of the guide assembly 40 in its second or generally horizontal position. In a preferred embodiment, a fixed tee 14 is located on the turf 22 so that a golf ball 12 is positioned upon the tee 14 by the guide assembly 40 in its second or generally horizontal position. In another preferred embodiment, the tee 14 is only temporarily fixed to the turf 22 so that the tee 14 can be removed by the golfer if desired.

In an alternate embodiment, the turf 22 can be removed from the base 20. Such a configuration allows the golfer to use the golf ball dispensing and teeing device 10 in association with an existing tee and/or turf. For example, the turf 22 could be removed from the base 20 and the opening in the base positioned around the existing turf and tee of a driving range.

Figure 3:
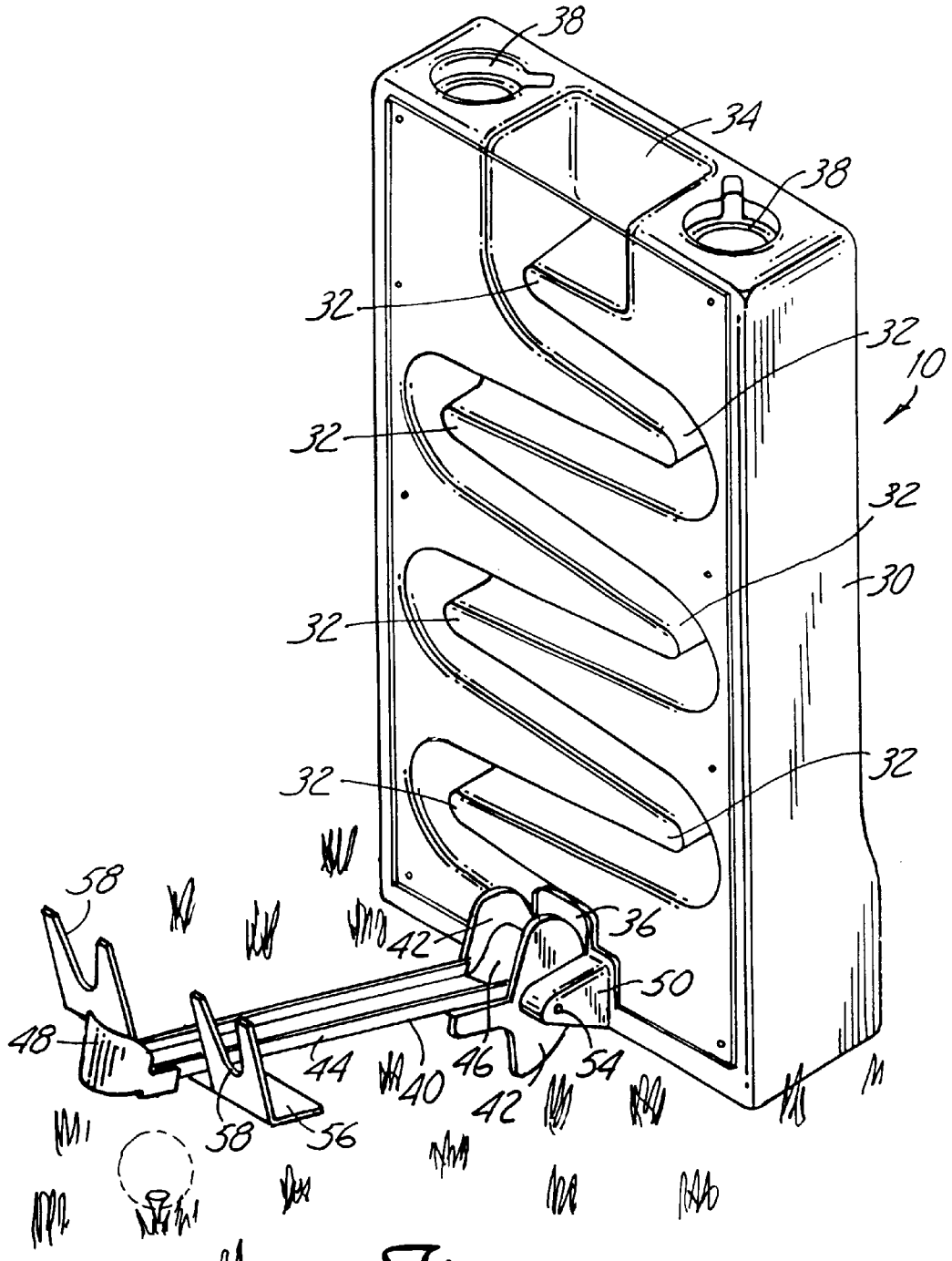
FIG. 3 is a perspective view of an alternate embodiment of the invention.
Figure 4:
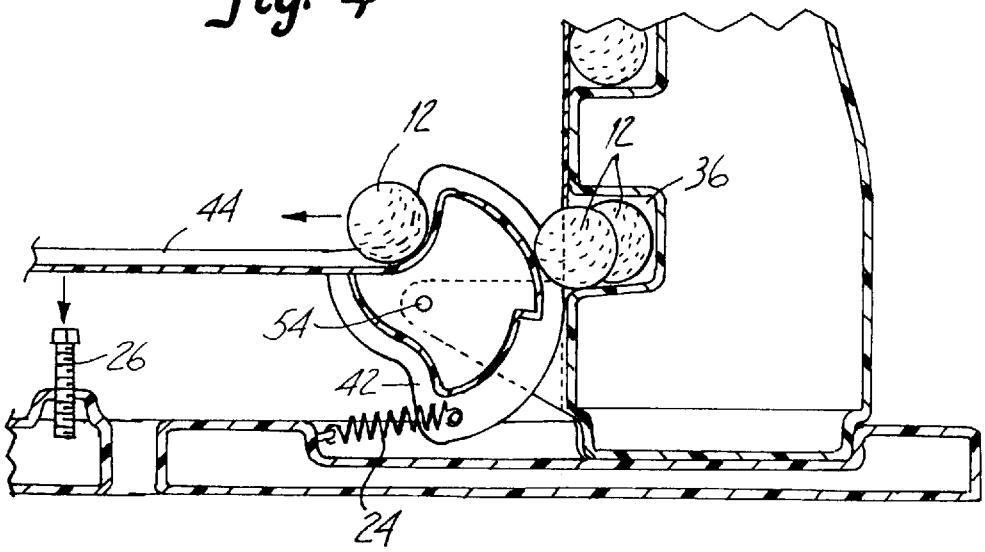
FIG. 4 is a cross sectional partial view of the guide assembly in its second position.
Figure 5:
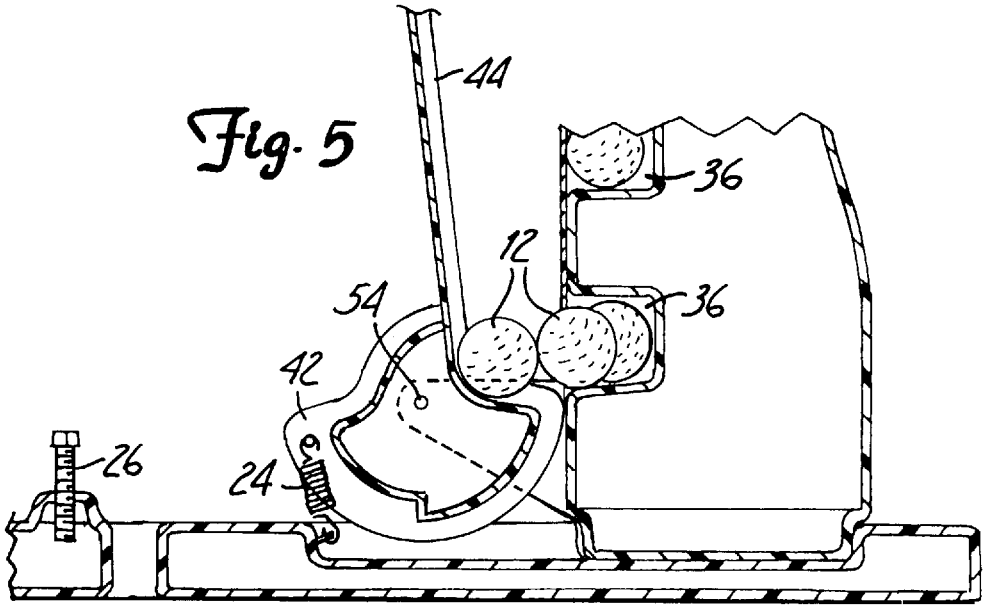
FIG. 5 is a cross sectional partial view of the guide assembly in its first position.

FIG. 3 depicts a further embodiment of the present invention. In this embodiment, the base 20 is shorter than in the previous embodiments and does not extend to the end of the guide assembly 40 in its second or generally horizontal position. This embodiment allows the golf ball dispensing and teeing device 10 to be used with a preexisting turf and tee arrangement. This configuration also allows the golf ball dispensing and teeing device 10 to be used in a variety of settings such as the outdoors where the golfer wishes to hit the golf ball directly off the ground or where the golfer desires to use his or her own tee.

In a preferred embodiment, the base 20 includes means for securing the base 20 to a surface. The securing means can consist of any appropriate devices. In one embodiment, the base 20 contains apertures situated around the edges of the base 20 through which screws, nails or other attachment devices can be inserted. In an alternate embodiment, the base 20 is permanently affixed to the surface.

As can be seen in FIGS. 1 and 3, the golf ball dispensing and teeing device 10 includes a housing 30 attached to the base 20. The housing 30 can be of any appropriate dimensions and configurations that allow for it to store golf balls 12 in a manner which permits the golf balls 12 to communicate with the guide assembly 40. In a preferred embodiment, the housing 30 is generally rectangular in shape and positioned generally perpendicularly with respect to the base 20.

The golf balls 12 can be stored within the housing 30 in any appropriate manner. In a preferred embodiment, the housing 30 includes a series of ramps 32. The ramps 32 can be constructed of any appropriate material that allows for the smooth passage of the golf balls 12. In a preferred embodiment, a series of ramps 32 is positioned generally vertically within the housing 30.

As can be seen in the figures, in the preferred embodiment the housing 30 has multiple sets of ramps 32. Within each set, the ramps 32 are vertically positioned in a series. The set of ramps 32 are interwoven in an opposing fashion with one set of ramps 32 offset with respect to the other set of ramps 32. Also in the preferred embodiment, each ramp 32 is generally sloped downward. In this configuration, the golf balls 12 contained within the housing 30 travel downwardly toward the guide assembly 40 in a serpentine manner.

The configuration of the ramp 32 can be of any suitable design that allows for the golf balls 12 to move down the serpentine pattern in a relatively smooth fashion. In the preferred embodiment, the surface of the ramps 32 is slightly concave so as to help secure the golf balls 12 on the ramps 32.

The housing 30 also contains means for loading the interior of the housing 30 with golf balls 12. As shown in FIGS. 1 and 3, in the preferred embodiment, an opening 34 is located at the top of the housing 30. The opening 34 is large enough to allow golf balls 12 to be poured or otherwise inserted into the housing 30 at a position on the uppermost ramp 32.

The housing 30 also contains an aperture 36 at the base of the housing 30. This aperture 36 allows the golf balls 12 to exit the housing 30 and reach the guide assembly 40. The aperture 36 can be of any suitable configuration that allows for the passage of a golf ball 12. In a preferred embodiment, the aperture 36 does not extend beyond the supports 42 of the guide assembly 40, thereby assuring that the golf ball 12 is properly directed toward the guide assembly 40 for deposit onto the tee.

In an alternate embodiment, the top of the housing 30 also includes cup holders 38 positioned on either end of the opening 34. These cup holders 38 allow a golfer to conveniently store a beverage or other item on the housing 30 while using the golf ball dispensing and teeing device 10.

In the preferred embodiment, the housing 30 is encased, other than the opening 34 and aperture 36, so as to prevent the golf balls 12 from unintentionally exiting the housing 30. The housing 30 can be encased in any appropriate materials. In a preferred embodiment, the front surface of the housing 30 is comprised of a plexiglass or other transparent or semitransparent material. This allows the golfer to view the golf balls 12 within the housing 30 so as to easily determine the number of golf balls 12 remaining in the housing 30.

The housing 30 is in communication with the guide assembly 40. The guide assembly 40 serves to direct a golf ball 12 from the housing 30, deliver the golf ball 12 a distance from the housing 30 and deposit the golf ball 12 onto a tee 14 or the ground at a location desired by the golfer. After depositing the golf ball 12, the guide assembly 40 retracts or otherwise repositions itself so that it is away from the golf ball 12 and will not interfere with the swing of the golfer.

The guide assembly 40 includes an arm 44, a catch 46 at one end of the arm 44, a stop 48 at the other end of the arm 44 and supports 42 positioned at either end of the catch 46. In a preferred embodiment, the guide assembly 40 is located towards the bottom of the housing 30 near the base 20 and is positioned so that it is generally centered in front of the housing 30.

The guide assembly 40 can be secured to the golf ball dispensing and teeing device 10 in any appropriate manner which allows for the guide assembly 40 to pivot between a first or generally vertical position and a second or generally horizontal position. In a preferred embodiment, braces 50 are used to support the guide assembly 40 and allow it to pivot about the braces 50. In a preferred embodiment, the braces 50 extend outward from the base 20 of the housing 30 and are generally rectangular in shape. In an alternate embodiment, the braces 50 extend upwardly from the base 20.

Positioned at one end of the arm 44 is the catch 46. The catch 46 is positioned outside of the housing 30 and in front of the aperture 36 at the base of the housing 30. The catch 46 is configured to receive a golf ball 12 that exits from the aperture 36. The catch 36 then directs the golf ball 12 down the arm 44 towards the stop 48. As such, the catch 46 is generally configured so that it is sloped towards the stop 48 while remaining open to receive the golf ball 12 through the aperture 36.

Located on opposing sides of the catch 46 are supports 42. The supports 42 extend beyond the catch 46. This configuration serves to ensure that a golf ball 12 located on the catch 46 will not fall off of the catch 46 or travel in a direction other than on the arm 44 towards the stop 48.

As mentioned, the guide assembly 40 is secured to the golf ball dispensing and teeing device 10 in a manner that allows the guide assembly 40 to pivot so as to retrieve a golf ball 12 in the catch 46 and transport the golf ball 12 to the hole 52. In a preferred embodiment, the guide assembly 40 is secured to the golf ball dispensing and teeing device 10 by means of the braces 50. A pin 54 is inserted through the braces 50, supports 42 and catch 46. This configuration allows the guide assembly 40 to pivot about the pin 54 from a relatively vertical first position to a relatively horizontal second position and back again.

Attached to and supported by the supports 42 is the arm 44 of the guide assembly 40. The arm 44 is configured so as to allow a golf ball 12 to travel from the catch 46 towards the stop 48 and to the hold 52. In a preferred embodiment, the arm 44 extends outward from the catch 46 and is generally rectangular in shape with side walls extending upward so that the golf ball 12 will not fall off of the sides of the arm 44. The width of the arm 44 is sufficient to allow the golf ball 12 to travel down the arm 44 with a minimum of lateral motion. The side walls of the arm 44 ensure that the golf ball 12 does not fall off the arm 44 as the golf ball 12 travels down the arm 44 towards the hole 52.

At the end of the arm 44 opposite the catch 46 is the stop 48. The stop 48 positioned at the end of the arm 44 behind the hole 52 serves to both prevent a golf ball 12 from falling off the end of the arm 44 and also ensures that the golf ball 12 will be directed to the hole 52 for proper placement on a tee or other surface. The stop 48 can be of any appropriate configuration that serves these functions. In a preferred embodiment, the stop 48 contains an arced profile that is capable of receiving the golf ball 12 with a minimum of disruption of the golf ball's velocity and also assists in directing the golf ball 12 down the hole 52.

As previously mentioned, the guide assembly 40 pivots so that it travels between a first generally vertical position to a second generally horizontal position and then back to the first generally vertical position. This movement can be accomplished in a number of fashions. In one embodiment, the guide assembly 40 is counterbalanced or otherwise weighted so that it can be stationed at the two positions.

In an alternate embodiment, a spring is used to allow the guide assembly 40 to travel from the first position to second position and then brought back to the first position. In a preferred embodiment, the spring is positioned so that the guide assembly 40 is biased towards its first generally vertical position. Thus, after the guide assembly 40 is lowered and a golf ball 12 deposited through the hole 52, the guide assembly 40 then returns to its first generally vertical position.

The spring 24 can be positioned on the golf ball dispensing and teeing device 10 in any appropriate location. In a preferred embodiment, one end of the spring 24 is attached to the base 20 and the other end of the spring 24 is attached to the underside of the guide assembly 40 on or near the catch 46. In this embodiment, the end of the spring 24 attached to the base 20 is closer to the peg 26 on the base 20 than the other end of the spring 24 attached to the guide assembly 40. Thus, when the guide assembly 40 is in its second generally horizontal position, the spring 24 is stretched. After the golf ball 12 is deposited through the hole 52, the spring 24 then acts to return the guide assembly 40 to its first generally vertical position.

In an alternate embodiment, one end of the spring 24 is attached to the housing 30 and the other end of the spring 24 is attached to the guide assembly 40 near the catch 46. The spring 24 is positioned so as not to interfere with the movement of a golf ball 12 from the housing 30 to the guide assembly 40.

In the preferred embodiment, the golf dispensing and teeing device 10 includes means for activating the guide assembly 40 to position a golf ball 12 on a tee or at another desired location. As can be seen from the figures, in an alternate embodiment, the guide assembly 40 includes a bar 56 which, when pressure is applied, causes the guide assembly 40 to move from its first generally vertical position to its second generally horizontal position.

The bar 56 can be of any appropriate configuration which allows for the grasping of it by the golfer, an implement held by the golfer or mechanical means. Various embodiments of the bar 56 include material extending from the sides of the arm 44 or from the sides or top of the stop 48.

In a preferred embodiment, the bar 56 extends outwardly from one of the sides of the arm 44 of the guide assembly 40 in a generally perpendicular manner. In an alternate embodiment, the bar 56 extends outwardly from both sides of the arm 44 of the guide assembly 40 in a generally perpendicular fashion. By having the bar 56 extend from either side of the arm 44, the bar 56 can be easily grasped by the golfer by the use of a golf club or other device without regard to whether the golfer is predominately left-handed or right-handed.

In an alternate embodiment, the bar 56 includes notches 58. The notches 58 assist the golfer in grasping the bar 56 with the head of a golf club. The notches 58 can be padded or otherwise softened so as to prevent any scratches or other degradation to the golf club.

The base 20 also preferably includes a peg 26 which limits the second generally horizontal position of the guide assembly 40. The peg 26 is situated on the base 20 underneath the guide assembly 40 and is capable of making contact with the arm 44 of the guide assembly 40 if the guide assembly 40 is lowered a sufficient amount.

The peg 26 can be of any appropriate configuration. In one embodiment, the peg is generally circular in a cross section and extends upwardly from the base 20 towards the arm 44 of the guide assembly 40. The peg 26 can be made of an appropriate material or covered with an appropriate material so that the impact of the arm 44 of the guide assembly 40 on the peg 26 is deadened and the arm 44 is not damaged by such impact.

In use, the golf ball dispensing and teeing device's versatility allows for its use in a variety of environments. The use of the turf 22 and fixed tee 14 will depend upon the desires of the golfer or the setting in which the golf ball dispensing and teeing device 10 is used. The basic operation of the golf ball dispensing and teeing device 10, however, remain the same whether a fixed tee is used or the fixed tee is removed.

Once the golf ball dispensing and teeing device 10 is set up and positioned for use, the housing 30 is loaded with golf balls 12 by inserting the golf balls 12 through the opening 34 at the top of the housing 30. The number of golf balls 12 held by the housing 30 will depend upon the size of the housing 30. In a preferred embodiment, the housing 30 can hold between 50 and 75 golf balls 12.

The golf balls 12 travel down the ramps 32 so that they are lined up in a generally serpentine fashion. With the guide assembly 40 in its first generally vertical position, the bottom-most golf ball 12 in the housing 30 will exit the aperture 36 at the bottom of the housing 30 and reside in the catch 46 of the guide assembly 40.

In order to activate the golf ball dispensing and teeing device 10 and position a golf ball 12 upon a tee or other surface, the golfer extends his or her golf club and positions the golf club in the notches 58 of the bar 56. As described above, positioning the guide assembly 40 generally in the center of the housing 30 and extending the bar 56 on either side of the arm 44 allows the golfer to easily engage the bar 56 regardless of whether the golfer is predominately left-handed or right-handed.

After the golf club is engaged in the notches 58 of the bar 56, the golfer pulls back on the bar 56 and lowers the guide assembly 40 to its second generally horizontal position. This action causes the catch 46 and arm 44 to pivot about the pin 54 where the slope of the catch 46 leads toward the arm 44. The golf ball 12 exits the catch 46 and travels down the arm 44 towards the hole 52. The golf ball 12 is prevented from overshooting the hole 52 by the stop 48.

When the golf ball 12 reaches the hole 52 it falls down the hole 52 and is deposited in the exact spot desired by the golfer. Such spot could be either a fixed tee, temporary tee or a desired spot on turf or other surface.

After the guide assembly 40 is lowered and the golf ball 12 deposited in the desired spot, the golfer removes the golf club from the bar 56. The bias of the spring 24 causes the guide assembly 40 to return to its first generally vertical position close to the housing 30. This same action causes the catch 46 to rotate back to its first position and allows the next golf ball 12 in line within the housing 30 to exit the housing 30 through the aperture 36 and reside in the catch 46. While the guide assembly 40 is in its second generally horizontal position, the catch 46 located outside of the housing 30 prevents the next golf ball 12 in line within the housing 30 from exiting the housing 30 through the aperture 36.

If the golf ball dispensing and teeing device 10 is to be used in an environment that already has a fixed tee, the version of the golf ball dispensing and teeing device 10 without the turf and fixed tee can be employed. Either the version of the golf ball dispensing and teeing device 10 with the shorter base 12 or the version of the golf ball dispensing and teeing device 10 with the longer base 20 would be appropriate. For this latter device, the section of turf 22 and fixed tee 14 would be removed from the base 20 and the opening left by the turf 22 positioned around the existing turf and/or fixed tee.

If a golfer wishes to have a self-contained golf ball dispensing and teeing device 10 that includes turf 22 and a fixed tee 14, the version of the device with these items is appropriate. As mentioned, the turf 22 and fixed tee 14 can be removed if the golfer wishes to have a golf ball deposited in another location.

As the golf ball dispensing and teeing device 10 has only one moving part, operation of the device 10 is simple and effective. Additionally, the device 10 is very durable and requires little maintenance.

While a preferred embodiment of the present invention has been described, it should be understood that various changes, adaptations and modifications may be made therein without departure from the spirit of the invention and scope of the appended claims.

What is claimed is:

1. A golf ball dispenser for automatically teeing up a golf ball, comprising:

a base;

a housing secured to the base, a series of ramps vertically positioned within the housing, the housing capable of storing a plurality of golf balls in a serpentine fashion on the ramps;

a guide assembly secured to the base of the housing and located outside of the housing in a location generally centered with respect to the housing, the guide assembly being able to pivot between a first generally vertical position and a second generally horizontal position, the guide assembly including an arm extending outwardly from the housing, supports located on either side of the arm, the arm defining an aperture at the end of the arm opposite the supports, and a bar extending outwards on either side of the arm;

a catch located on one end of the guide assembly, the catch being configured to receive a golf ball from the housing when the guide assembly is in the first generally vertical position so that the golf ball positioned within the catch is located partially outside of the housing;

the catch being disposed outside a line of travel of the approaching golf balls; and the catch pivoting about an axis of rotation that is generally parallel to the line of travel of the approaching golf balls.

2. A golf ball dispenser for automatically teeing up a golf ball, comprising:

an integrally formed base;

an integrally formed housing secured to the base, the housing capable of storing a plurality of golf balls in a serpentine fashion along a serpentine path defined by a first guiding surface of the housing and a second guiding surface of the housing;

the first guiding surface and the second guiding surface being uniformly spaced apart from one another by a distance similar to a diameter of the golf ball;

the first guiding surface including a first curved portion, a second curved portion, and at least one straight portion;

the second guiding surface including a first curved portion, a second curved portion, and the at least one straight portion;

the at least one straight portion of the first guiding surface being generally parallel to at least one straight portion of the second guiding surface;

the at least one straight portion of the second guiding surface being shorter than about six diameters of the golf ball;

the first curved portion of the first guiding surface being concentric with the first curved portion of the second guiding surface;

the first curved portion of the second guiding surface having a radius that is greater than a radius of the first curved portion of the first guiding surface by a distance similar to the diameter of the golf ball;

the second curved portion of the first guiding surface being concentric with the second curved portion of the second guiding surface;

the second curved portion of the first guiding surface having a radius that is greater than a radius of the second curved portion of the second guiding surface by a distance similar to the diameter of the golf ball;

a guide assembly secured to the base of the housing and located outside of the housing in a location generally centered with respect to the housing, the guide assembly being able to pivot between a first generally vertical position and a second generally horizontal position, the guide assembly including an arm extending outwardly from the housing and supports located on either side of the arm, the arm defining an aperture at the end of the arm opposite the supports;

a catch located on one end of the guide assembly, the catch being configured to receive a golf ball from the housing when the guide assembly is in the first generally vertical position so that the golf ball positioned within the catch is located partially outside of the housing;

the catch being disposed outside a line of travel of the approaching golf balls; and the catch pivoting about an axis of rotation that is generally parallel to the line of travel of the approaching golf balls.

3. The golf ball dispenser of claim 2 wherein the housing is secured to one end of the base.

4. The golf ball dispenser of claim 2 wherein the base and housing are generally planar with the plane of the housing being perpendicular to the plane of the base.

5. The golf ball dispenser of claim 2 wherein the housing is generally rectangular.

6. The golf ball dispenser of claim 5 wherein the serpentine path of the golf balls is co-planar with the length of the housing.

7. A golf ball dispenser for automatically teeing up a golf ball, comprising:

a base;

a housing secured to the base, the housing capable of storing a plurality of golf balls in a serpentine fashion;

a guide assembly secured to the base of the housing and located outside of the housing in a location generally centered with respect to the housing, the guide assembly being able to pivot between a first generally vertical position and a second generally horizontal position, the guide assembly including an arm extending outwardly from the housing and supports located on either side of the arm, the arm defining an aperture at the end of the arm opposite the supports;

a catch located on one end of the guide assembly, the catch being configured to receive a golf ball from the housing when the guide assembly is in the first generally vertical position so that the golf ball positioned within the catch is located partially outside of the housing;

the catch being disposed outside a line of travel of the approaching golf balls; and the catch pivoting about an axis of rotation that is generally parallel to the line of travel of the approaching golf balls.

8. A golf ball dispenser for automatically teeing up a golf ball, comprising:

an integrally formed base;

an integrally formed generally rectangular housing secured to one end of the base;

a series of ramps vertically positioned within the housing, the housing capable of storing a plurality of golf balls in a serpentine fashion on the ramps;

a guide assembly secured to the base of the housing and located outside of the housing in a location generally centered with respect to the housing, the guide assembly being able to pivot between a first generally vertical position and a second generally horizontal position, the guide assembly including an arm extending outwardly from the housing, supports located on either side of the arm, the arm defining an aperture at the end of the arm opposite the supports; and a catch located on one end of the guide assembly, the catch being configured to receive a golf ball from the housing when the guide assembly is in the first generally vertical position so that the golf ball positioned within the catch is located partially outside of the housing;

the catch being disposed outside a line of travel of the golf balls approaching the catch; and the catch pivoting about an axis of rotation that is generally parallel to the line of travel of the golf balls approaching the catch.

* * * * *